United States Patent [19]

Beach

[11] Patent Number: 4,898,384

[45] Date of Patent: Feb. 6, 1990

[54] BATTING AID SYSTEM

[76] Inventor: G. Michael Beach, 7321 Morrison Dr., Greenbelt, Md. 20770

[21] Appl. No.: 208,099

[22] Filed: Jun. 17, 1988

[51] Int. Cl.[4] ..... A63B 69/40

[52] U.S. Cl. ..... 273/26 R; 273/26 B; 273/29 A; 273/72 R

[58] Field of Search ..... 273/26 R, 26 B, 72 R, 273/29 A, 183 D, 186 A, 194 R, 194 A, 194 B; 272/124; 73/493, 517, 826.19, 494; 446/404, 409, 420, 421

[56] References Cited

U.S. PATENT DOCUMENTS

| | | | |
|---|---|---|---|
| 2,471,610 | 10/1946 | Christensen | 273/26 B |
| 2,780,098 | 2/1957 | Maroth | 273/186 A |
| 3,173,688 | 3/1965 | Green | 273/72 R |
| 3,414,260 | 12/1968 | Gust | 273/72 R |
| 4,163,552 | 8/1979 | Tiso | 273/193 A |
| 4,534,121 | 1/1982 | Sasaki | 272/124 |

OTHER PUBLICATIONS

Mechanisms, Linkages and Mechanical Controls, Chironis, 1965, pp. 143, 144, 149.

*Primary Examiner*—Edward M. Coven
*Assistant Examiner*—Dean Small
*Attorney, Agent, or Firm*—David I. Klein; Morton J. Rosenberg

[57] ABSTRACT

A batting aid system (10) is provided for training a baseball player to properly swing a baseball bat. The batting aid system (10) includes a longitudinally extended handle member (20) defining a longitudinal axis (15). Handle member (20) is configured to simulate the contour of a conventional baseball bat, having cylindrical hand grip portion (22), a conical intermediate portion (23) extending to a truncated cylindrical distal end (24). An audible feedback system (30) having a weighted wheel member (32) is pivotedly coupled to the distal end (24) of handle member (20) for providing an audible output responsive to rotative displacement of handle member (20) about its longitudinal axis (15). The audible output is generated by a sound generating system (40) having a pawl (44) coupled to the handle member (20) and positionally disposed to contact the gear-tooth-like projections (46) of ratchet member (42), ratchet member (42) being coupled to weighted wheel member (32) and rotatively displaced therewith.

19 Claims, 2 Drawing Sheets

BATTING AID SYSTEM

BACKGROUND OF THE INVENTION

1. FIELD OF THE INVENTION

This invention directs itself to batting aid systems for teaching the proper swing of a baseball bat. In particular, this invention directs itself to training aids which provide audible feedback as indicators of proper swing. More in particular, this invention pertains to audible feedback systems which are responsive to rotative displacement of a handle member, representing a baseball bat, about its longitudinal axis. Further, this invention directs itself to batting aid systems having a pivotedly mounted element functioning as a flywheel for dissipating the rotative force applied to the handle member through its rotation.

2. PRIOR ART

Batting aid systems are well known in the art. The best known prior art to the Applicant include U.S. Pat. Nos. 2,772,887; 2,471,610; 3,173,688; 4,511,139; 3,113,781; 3,113,782; 3,971,559; 3,353,824; 4,555,111; 3,351,346; and, 2,780,098. In some prior art systems as that shown in U.S. Pat. Nos. 2,772,887, 3,173,688, and 4,511,139 there are provided batting aid devices for teaching correct arm and body movements during the swing of bats, clubs, and rackets. However, these systems employ weighted members which move either linearly along the bat's longitudinal axis or radially about a plane normal to the longitudinal axis. Thus, these devices are responsive to either centrifugal force produced during the swing of the device or to changes in the radial motion of the bat, such as when the batter snaps his wrist. None of these devices provides for audible feedback responsive to rotative forces being applied to the device about its longitudinal axis, as provided by the instant invention. It has been established that greater energy can be imparted to a baseball if the bat is rotated about its longitudinal axis when the ball is struck. It is therefore advantageous to provide a training aid responsive to the desired rotative motion of the bat.

In other prior art systems, such as in U.S. Pat. No. 2,471,610, there are provided practice bat systems having a rotatable member pivotedly mounted for rotation about a longitudinal axis of a handle member. Such devices are intended for training of batters to accurately and squarely hit a ball. When the bat is swung and the ball struck by the rotatable portion such rotates on impact if the ball is not hit squarely, reducing the impact, and thus providing a possible visual indication of an improper swing. However, such systems do not provide for audible feedback responsive to the deliberate application of rotative force to the handle portion of the device, as provided by the instant invention.

SUMMARY OF THE INVENTION

A batting aid system for training a baseball player to properly swing a baseball bat is provided. The batting aid system includes a longitudinally extended handle member defining a longitudinal axis and having a gripping portion positionally located at a first end of the handle member. The batting aid system also includes an audible feedback system pivotedly coupled to a second end of the handle member for indicating a proper baseball bat swing. The audible output from the audible feedback system is responsive to rotative displacement of the handle member about its longitudinal axis during a swing of the batting aid system in simulation of the swing of a baseball bat.

DESCRIPTION OF THE PREFERRED EMBODIMENTS

Figure 1:
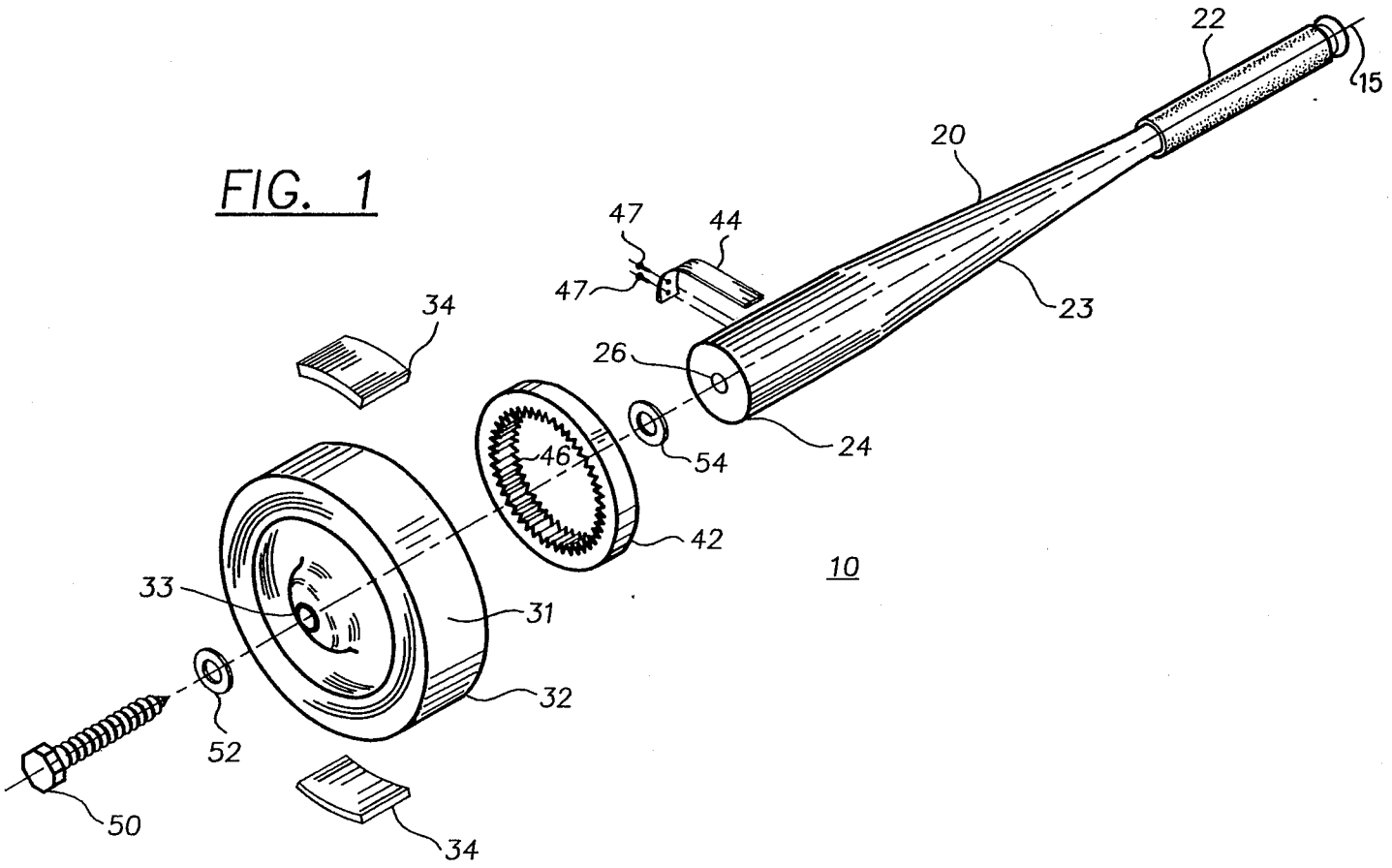
FIG. 1 is a perspective exploded view of the batting aid system.
Figure 2:
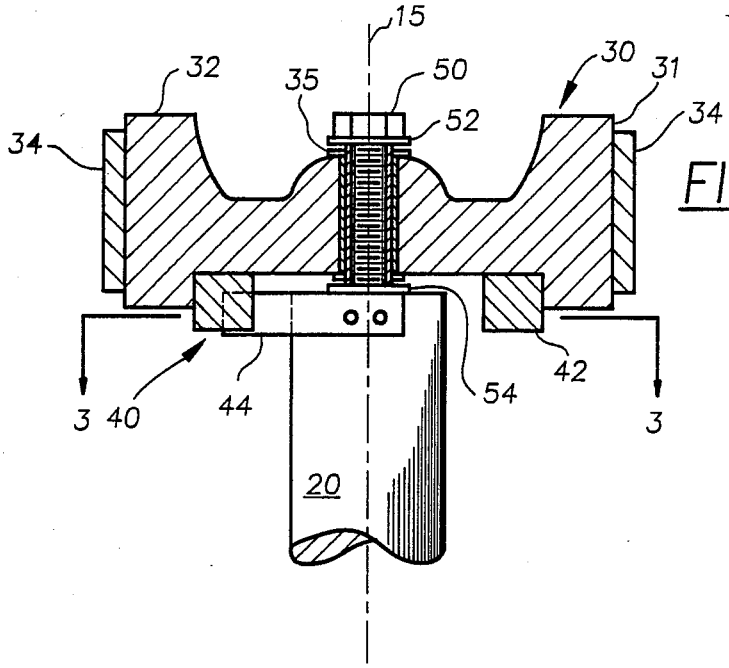
FIG. 2 is a partial cross-sectional view of a portion of the batting aid system; and, FIG. 3 is a sectional view of the batting aid system taken on the section line 3—3 of FIG. 2.
Figure 3:
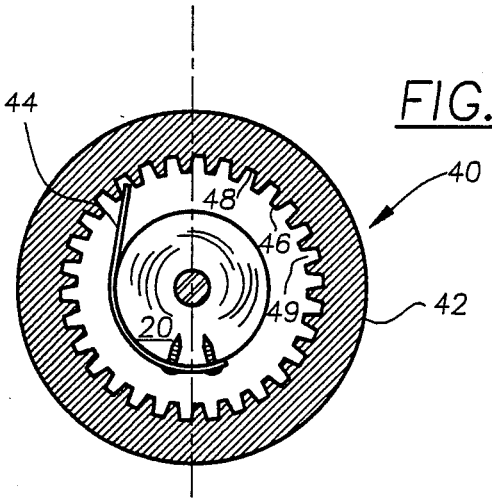

Referring now to FIGS. 1–3, there is shown batting aid system 10 for training a baseball player to properly swing a baseball bat. As will be seen in following paragraphs, batting aid system 10 is specifically directed to the concept of providing a training device having a handle grip portion whose contour simulates that of a conventional baseball bat, and providing an audible feedback responsive to rotative displacement of the handle about its longitudinal axis. As system 10 is swung in simulation of a baseball bat swing. Batting aid system 10 is particularly adapted to teach the user to apply rotative force to the baseball bat about its longitudinal axis as it is radially displaced about the user during a batting swing. The audible feedback provided by batting aid system 10 provides both an indication of the rotative displacement of simulated baseball bat 20 about its longitudinal axis 15 and a qualitative indication of the rotative force applied thereto.

As shown in FIG. 1, batting aid system 10 includes a handle member 20 having a hand grip portion 22 located at one end of handle member 20. The contour of handle member 20 simulates that of a conventional baseball bat in that the hand grip end 22 is formed by a cylindrically shaped portion of relatively constant diameter which extends to an intermediate portion 23 having a conical contour extending from the hand grip portion 22 and increasing in diameter to provide a transition from the hand grip portion 22 to the distal end portion 24. Intermediate handle portion 23 extends from the hand grip portion 22 to the distal end portion 24. Distal end portion 24 has a cylindrical contour of a diameter greater than that of the hand grip portion 22. Thus hand grip portion 22, intermediate portion 23, and distal end portion 24 together define an overall contour for handle member 20 which closely approximates that of a conventional baseball bat. Handle member 20 can be formed from any of a number of material compositions, such as metal, plastic, wood, or composite compositions employing resinous binders and natural or synthetic fibers, such as graphite, kevlar, boron, or the like.

Referring now to FIGS. 1 and 2, there is shown the audible feedback system 30 rotatively coupled to handle member 20. Audible feedback system 30 is provided with a sound generating system 40 for providing an audible indication of relative rotative displacement between a portion of the audible feedback system 30 and handle member 20. Audible feedback system 30 includes a weighted wheel member 32 pivotedly coupled to the distal end 24 of handle member 20 such that it freely rotates about the longitudinal axis 15 of handle member 20. Weighted wheel member 32 is pivotedly coupled to the distal end 24 of handle member 20 by a threaded fastener 50 which is received within a longitudinally extending bore located in the distal end 24 of handle member 20. Free rotation of weighted wheel member 32 about the fastener 50 is aided by a pair of washers 52 and 54 located on opposing sides of wheel member 32 and a sleeve bearing member 35 extending therebetween, within through opening 33 of wheel member 32. Obviously, other fastening methods could be employed to provide the rotative coupling for the weighted member 32 to handle member 20.

Weighted wheel member 32 having a longitudinally extended truncated cylindrical contour is constructed such that the majority of the mass of weighted wheel member 32 is located about its perimeter. To enhance the rotative movement about longitudinal axis 15 a plurality of weights 34 can be fixedly coupled to the external cylindrical perimeter surface 31 of weighted wheel member 32. Coupling of weights 34 to cylindrical surface 31 can be accomplished by any of a wide variety of fastening systems or bonding techniques, well known in the art. The relatively large mass located radially about and displaced from the longitudinal axis 15, formed by weighted wheel member 32 in combination with weights 34, permits weighted wheel member 32 to act as a flywheel for receiving rotative force from handle member 20 and rotatively dissipate that energy to provide relative displacement between weighted wheel member 32 and handle member 20.

As seen in FIGS. 1–3, audible feedback system 30 includes sound generating system 40 responsive to the relative displacement of weighted wheel member 32 about longitudinal axis 15, relative to handle member 20. Sound generating system 40 includes a ratchet member 42 fixedly coupled to weighted wheel member 30 and a pawl member 44 fixedly coupled to handle member 20. Ratchet member 42 is formed by an annulus having a plurality of geartooth-like projections 46 extending from the interior surface 48 of ratchet member 42, and disposed symmetrically thereon. Pawl member 44 is fixedly coupled on one end to the distal end portion 24 of handle member 20 by a plurality of fasteners 47, and extends therefrom such that the opposing end of pawl member 44 contacts the projections 46 of ratchet member 42.

Thus, pawl member 44 provides a means for transmitting rotative forces from handle member 20 to weighted wheel member 32, through ratchet member 42 which is fixedly coupled thereto. Additionally, as pawl member 44 passes from contact with one projection 46 to another through the intervening spaces 49, it is caused to vibrate and thereby emit an audible sound. Thus, the intermittent contact between pawl member 44 and the projections 46, created by relative displacement between ratchet member 42 and pawl member 44, generates a clicking sound.

Obviously, the more rotative force transferred to weighted wheel member 32, the longer the period of time that weighted wheel member 32 will rotate, and larger its initial velocity. Thus, a qualitative feedback will be provided by the repetition rate of the clicking sound and the relative length of time over which the sound is generated.

The batting aid system 10 is provided with a handle member 20 having a baseball bat like contour wherein the user grasps system 10 by the gripping portion 22 of handle 20. When batting aid system 10 is properly swung, in simulation of a correct baseball bat swing wherein a rotative moment about the bat's longitudinal axis is added, audible feedback system 30 having sound generating system 40 provides an audible feedback in the form of a clicking sound responsive to the rotative force being applied to handle member 20 about its longitudinal axis 15.

Audible feedback system 30 includes a weighted wheel member 32, acting as a flywheel, for receiving the rotative force applied to handle member 20 coupled through pawl member 44 and ratchet member 42 of sound generating system 40. Although weighted wheel member 32 has been described as a longitudinally extended truncated cylindrical member, weighted wheel member 32 may be configured in other contours having a symmetrically located mass radially positioned about its pivotal axis. Thus, weighted wheel member 32 could be spherically shaped or constructed by a plurality of spokes extending radially from its pivotal axis having a discrete mass fixedly coupled to each spoke. As it is the flywheel function of weighted wheel member 32 that is important to the inventive concept and not its particular shape or contour.

Pawl member 44 being fixedly coupled to the distal end 24 of handle member 20 by fasteners 47 functionally serves two purposes in batting aid system 10, as does ratchet member 42. Pawl member 44 transmits the rotative force applied to handle member 20 by the user to ratchet member 42, by virtue of the geartooth-like projections 46 with which pawl member 44 comes in contact and pushes against during rotative displacement of handle member 20 about its longitudinal axis 15. Ratchet member 42 being fixedly coupled to weighted wheel member 32 couples the rotative force, from pawl member 44, thereto. Weighted wheel member 32, acting as a flywheel freely spins about fastener 50 defining the pivotal axis for weighted wheel member 32 which is colocated on the longitudinal axis 15 of handle member 20. At weighted wheel member 32 freely spins, pawl member 44 is intermittently struck by the projections 46 of ratchet member 42, producing a ratcheting or clicking sound to provide audible feedback to the user.

The sound generated by ratchet member 42 and pawl member 44 varies in repetition rate and overall sound emitting duration, responsive to the magnitude of the rotative force applied to handle member 20. Thus, variations in the repetition rate and sound duration can be used to qualitatively assess the swing of the user and thereby aid in the teaching of the proper swinging of a baseball bat.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases particular locations of elements may be reversed or interposed, all without departing from the spirit or scope of the invention as defined in the appended claims.

What is claimed is:

1. A batting aid system for training a baseball player to properly swing a baseball bat, comprising:

a longitudinally extended handle member defining a longitudinal axis having a gripping portion positionally located at a first end of said handle member; and, audible feedback means pivotedly coupled to a second end of said handle member for indicating a proper baseball bat swing, said audible feedback means being responsive to rotative displacement of said handle member about said longitudinal axis during a swing of said system in simulation of a baseball bat swing, said audible feedback means having a central axis substantially coincident with said longitudinal axis and having a symmetrically located mass radially positioned about said central axis defining a flywheel, said audible feedback means includes sound generating means coupled to both said flywheel and said second end of said handle member for providing said indication of said proper baseball bat swing, said sound generating means including driving means coupled to said second end of said handle member for initiating rotation of said flywheel responsive to rotation of said handle member about said longitudinal axis and generating an audible sound.

2. The batting aid system as recited in claim 1 wherein said flywheel further defines a weighted member pivotedly coupled to said handle member.

3. The batting aid system as recited in claim 2 wherein said driving means includes a pawl member having a first end fixedly coupled to a portion of said second end of said handle member and a second end extending therefrom.

4. The batting aid system as recited in claim 3 wherein said sound generating means further includes a ratcheting member fixedly coupled to said weighted member.

5. The batting aid system as recited in claim 4 wherein said ratcheting member is formed by an annulus having a plurality of projections positionally spaced about an interior surface of said annulus and extending therefrom.

6. The batting aid system as recited in claim 5 wherein said pawl member second end is positionally located for contacting said projections of said ratcheting member.

7. The batting aid system as recited in claim 6 wherein said contact between said pawl member and said projections of said ratcheting, member are caused to be intermittent by said relative displacement between said weighted member and said handle member.

8. The batting aid system as recited in claim 7 wherein said intermittent contact between said pawl member and said projections of said ratcheting member causes said pawl member to produce an audible sound for providing said indication of proper baseball bat swing.

9. The batting aid system as recited in claim 1 wherein said handle member has a cylindrical contour simulating the contour of a conventional baseball bat.

10. A training device for teaching the proper swinging of a baseball bat, comprising:

a. a longitudinally extended handle member defining a longitudinal axis having a gripping portion positionally located at a first end of said handle member;

b. a weighted wheel member pivotedly coupled to a second end of said handle member for rotation about said longitudinal axis and having a symmetrically located mass radially positioned about said longitudinal axis; and c. audible sound generating means coupled to both said weighted wheel member and said handle member for audibly indicating rotation displacement about said longitudinal axis between said weighted wheel member and said handle member, said audible sound generating means includes driving means coupled to said handle member for initiating rotation of said weighted wheel member responsive to a rotation of said handle member about said longitudinal axis.

11. The training, device as recited in claim 10 wherein said drive means includes a pawl member having a first end fixedly coupled to a portion of said second end of said handle member, said pawl member having an opposing second end extending from said portion of said handle member second end.

12. The training system as recited in claim 11 wherein said audible sound generating means further includes a ratcheting member fixedly coupled to said weighted wheel member.

13. The training system as recited in claim 12 wherein said ratcheting member is formed by an annulus having a plurality of projections positionally spaced about an interior surface of said annulus and extending therefrom.

14. The training system as recited in claim 13 wherein said pawl member second end is positionally located for contacting said projections of said ratcheting member.

15. The training system as recited in claim 14 wherein said contact between said pawl member and said projections of said ratcheting member are caused to be intermittent by said rotative displacement between said weighted wheel member and said handle member.

16. The training system as recited in claim 15 wherein said intermittent contact between said pawl member and said projections of said ratcheting member causes said pawl member to produce an audible sound for providing an indication of a proper baseball bat swing.

17. The training system as recited in claim 10 wherein said weighted wheel member is formed by a cylindrical mass.

18. The training system as recited in claim 17 wherein said cylindrical mass is coupled to said handle member second end by a threaded fastener.

19. The training system as recited in claim 10 wherein said handle member has a cylindrical contour simulating the contour of a conventional baseball bat.

* * * * *